US007422111B1

(12) United States Patent
Bridger

(10) Patent No.: US 7,422,111 B1
(45) Date of Patent: Sep. 9, 2008

(54) NEEDLECRAFT ORGANIZERS AND METHODS OF CONSTRUCTION

(76) Inventor: Sophia Margaret Bridger, 1692 Riverview Rd., Chattanooga, TN (US) 37405

( * ) Notice: Subject to any disclaimer, the term of this patent is extended or adjusted under 35 U.S.C. 154(b) by 302 days.

(21) Appl. No.: 11/418,021

(22) Filed: May 4, 2006

Related U.S. Application Data

(60) Provisional application No. 60/679,735, filed on May 11, 2005.

(51) Int. Cl.
*B65D 69/00* (2006.01)

(52) U.S. Cl. ..... 206/574; 206/392; 150/106; 383/40

(58) Field of Classification Search ..... 206/37, 206/38, 216, 223, 225, 227, 388, 392, 409, 206/574; 150/106, 107, 112; 242/164, 170, 242/579, 590; 383/7, 39, 40, 106, 107, 117; 434/95

See application file for complete search history.

(56) References Cited

U.S. PATENT DOCUMENTS 2,796,905 A * 6/1957 Hebron ..... 150/106
5,251,743 A * 10/1993 Pulido et al. ..... 206/38.1
5,813,445 A * 9/1998 Christman ..... 150/106
5,826,714 A * 10/1998 Martin ..... 150/106
6,298,993 B1 * 10/2001 Kalozdi ..... 150/106
6,357,497 B1 * 3/2002 Frase ..... 206/574
6,431,359 B1 * 8/2002 Hollander ..... 206/459.5
6,959,806 B2 * 11/2005 Barker ..... 206/6.1

* cited by examiner

*Primary Examiner*—Luan K Bui
(74) *Attorney, Agent, or Firm*—Stephen J. Stark; Miller & Martin PLLC

(57) ABSTRACT

A yarn keeper has a front, back, two sides, bottom and top provided as discs. Most of the discs are joined at sew lines with at least one gap separating adjacent sew lines which provide access into an interior of the yarn keeper. The top is hingedly connected to the back and selectively securable relative to the front which provides the ability to insert a yarn ball therein and then the user can direct a yarn strand through a gap for use. The keeper has a storage configuration in which the sides, front and back are inwardly folded so that the top and bottom remain parallel, but closer together so that it could possibly preferably fit within a tote. The tote has an interior defined by zipper portions, sides, bottom and front and back with the zipper potion terminating intermediate the sides allowing items such as long needles to extend beyond the zipper portions.

20 Claims, 4 Drawing Sheets

NEEDLECRAFT ORGANIZERS AND METHODS OF CONSTRUCTION

CLAIM OF PRIORITY

This application claims the benefit of U.S. Provisional Patent Application No. 60/679,735 filed May 11, 2005.

FIELD OF THE INVENTION

The present invention relates to totes for use in transporting, storing, keeping and/or organizing supplies utilized in various needlecraft projects, and more particularly to totes, needle bags and yarn keeping devices.

DESCRIPTION OF RELATED ART

Needlecraft such as knitting, macrame, crochet, needlepoint, and other forms have been practiced for years and years. Recently, current events have brought more exposure to these crafts. However, as traditional crafts meet current "on the go" lifestyles, new methods of organization, portability and storage are believed to be necessary.

SUMMARY OF THE INVENTION

It is an object of the invention to provide attractive and functional storage and organization devices for use with needlecrafts.

It is another object of the present invention to provide a tote having see-through capability for allowing a user to quickly and easily assess its contents.

It is another object of the present invention to provide convenient storage for items such as long, slender needles which are often utilized with many needlecrafts.

It is another object of the present invention to provide convenient portability for various embodiments of totes, yarn keepers, and/or needle carriers.

Accordingly, three separate embodiments, which may or may not comprise three separate inventions are disclosed herein. First, a tote is disclosed. The tote preferably has a transparent front and back, as well as transparent sides. A bottom is preferably made to be opaque of a color which matches a purse configured to "disappear" into the bottom surface. The purse is preferably fixedly secured to one of the sides, front, back or bottom with a leash so that it can be taken out, have items placed in it, and then returned into the tote. The tote also preferably has an outer front pocket and an inside organizer pouch equipped with a number of pockets connected to the back. Handles are formed from strapping which is connected to the outer surfaces of the front, back and bottom. Finally ribbons and bias tape are utilized to provide an attractive and finished appearance.

Secondly, a yarn keeper is six-sided cube-like structure formed of discs joined together. The six discs form the top, back, bottom, front, right side and left side. The top is hingedly connected to the back and releasably connectable to the front thereby providing a storage area within the cube which may be accessed by releasing the top from the front. Gaps between the top and the sides, back and front allow for the passage of a yarn end from a closed keeper to pass through for use while the yarn bundle remains in the keeper. Similarly gaps may also be located between the bottom and the sides, back and front for a similar use. D-rings connected to the sides are useful to support a carrying strap.

The third device shown is a needle purse or wrap which is preferably constructed from a single, at least substantially planar frosted, or translucent, fabric which is folded upon itself and stitched to provide a plurality of pockets for storing needles and other accessories utilized for needlecraft projects. The edges are preferably trimmed in ribbon or bias tape, with a ribbon connected along one edge which allows a rolled wrap to be secured as a roll for convenient storage.

BRIEF DESCRIPTION OF THE DRAWINGS

The particular features and advantages of the invention as well as other objects will become apparent from the following description taken in connection with the accompanying drawings in which.

DETAILED DESCRIPTION OF THE PREFERRED EMBODIMENTS

Tote

Figure 1:
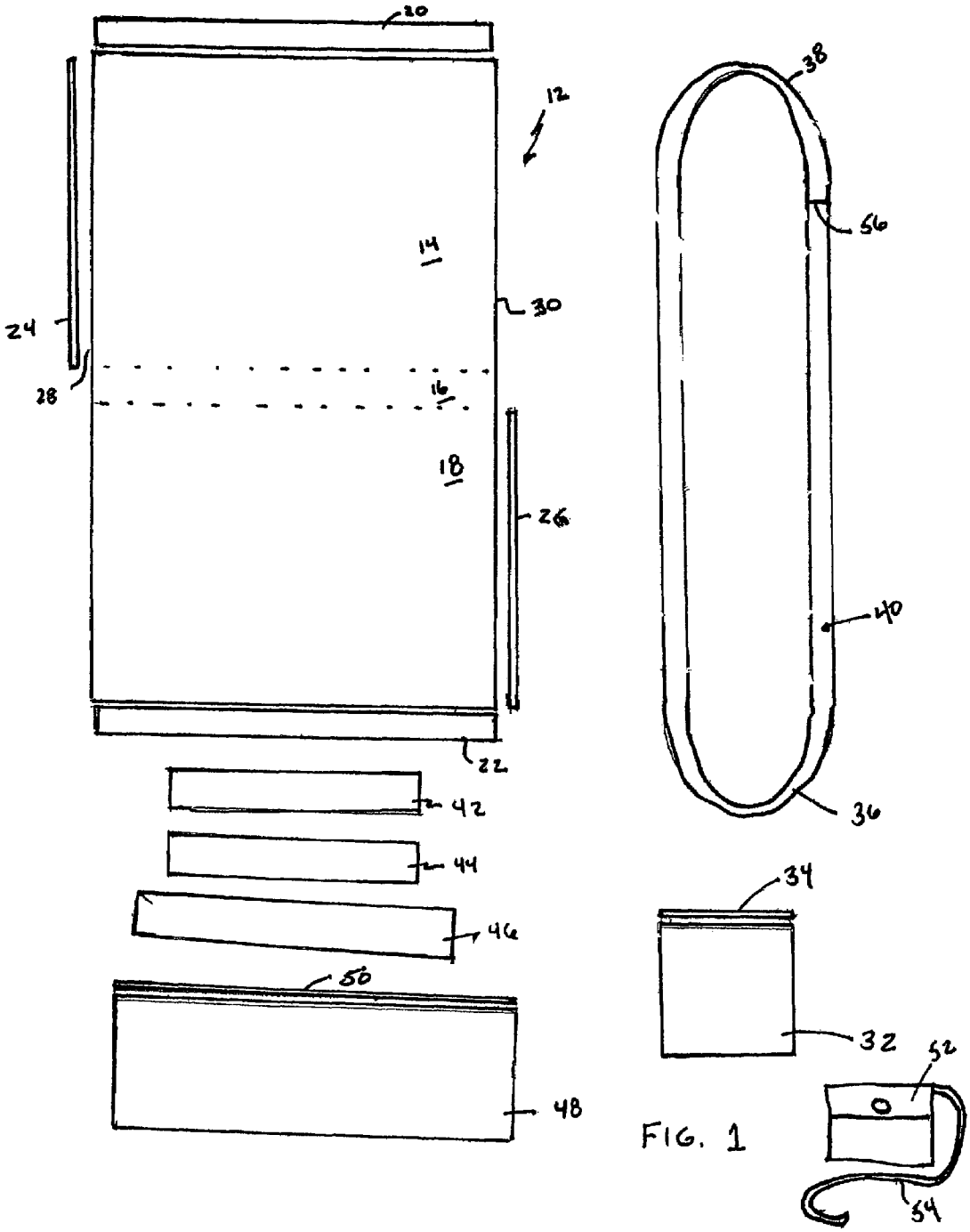
FIG. 1 is a plan view showing the component parts of a tote of the presently preferred embodiment prior to assembly.

FIGS. 1-5 shows various stages of construction of a tote 10 of a presently preferred embodiment. FIG. 1 shows the components of fabric 12 which forms front 14, bottom 16 and back 18. Ribbons 20, 22 provide trim at the top (when assembled) of the front 14 and back 18, as do binding tape 24, 26 along sides 28, 30. Front pocket 32 has binding tape 34 which will be connected at its opening on the front 14 as will be shown with reference to FIG. 2.

Handles 36, 38 are preferably formed from strapping 40 which forms at least a substantially continuous loop across the front 14, bottom 16 and back 18. This construction allows the strapping 40 to pass below the bottom 16 to support the weight of material within the tote 10.

Figure 5:
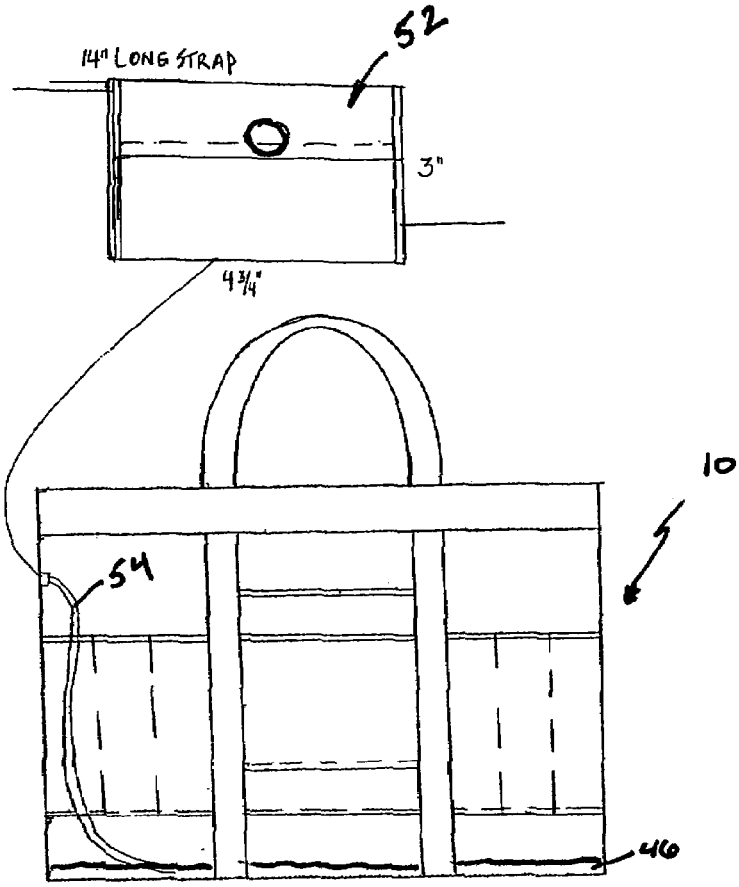
FIG. 5 shows a completed tote of the presently preferred embodiment.

Zippers 42, 44 are useful to connect the interiors of the front 14 to back 18. Bottom insert 46 is useful to provide support to the bottom 16. Finally, inside pouch 48 is useful, especially when divided into compartments as shown in later figures for storing such items as needles, accessories, etc. Binding tape 50 or other trim is also useful to trim out the entrance to the pouch to eliminate sharp edges from cutting fabric 12. Purse 52 with leash 54 is also useful to provide a place for storing such items as change, a driver's license, etc. in the tote 10 as will be explained below. Leash 54 may or may not be an additional length of binding tape 24 from one side of the tote 10 (i.e., such as folded into tote 10 at the top and resewn as shown in FIG. 5 or closer to the area of the ribbon 20).

The fabric 12 as well as the front pocket 32 and inside pouch 48 are preferably transparent, such as clear vinyl, but could also be formed of other materials as are known in the art for various other embodiments.

Figure 2:
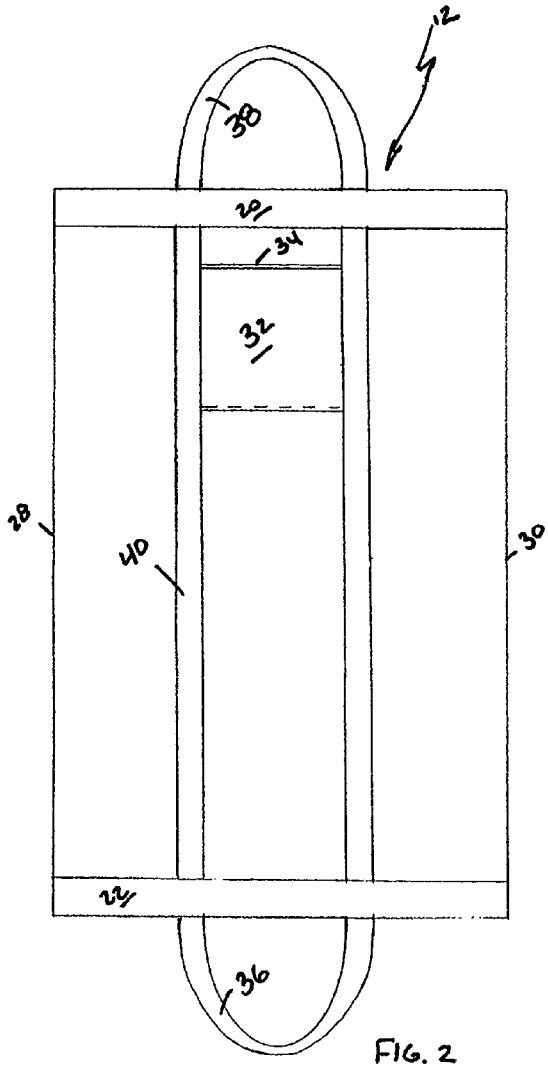
FIG. 2 shows the attachment of the handles, ribbon trim and front pocket to the exterior surfaces of the front and back of the tote as shown in FIG. 1.

FIG. 2 shows the exterior of the fabric 12 with the strapping 40 connected thereto as well as the front pocket 32 with attached trim 34 and ribbons 20,22. It is preferable that the front pocket 32 be sewn to the front 14 after attaching the trim 34 to the pocket 32. Next the strapping 40 is connected, preferably by sewing to the fabric 12 for a quality product. The ribbons 20,22 are also sewn to hide the seam 56 as shown in FIG. 1 and to provide an attractive border.

Figure 3:
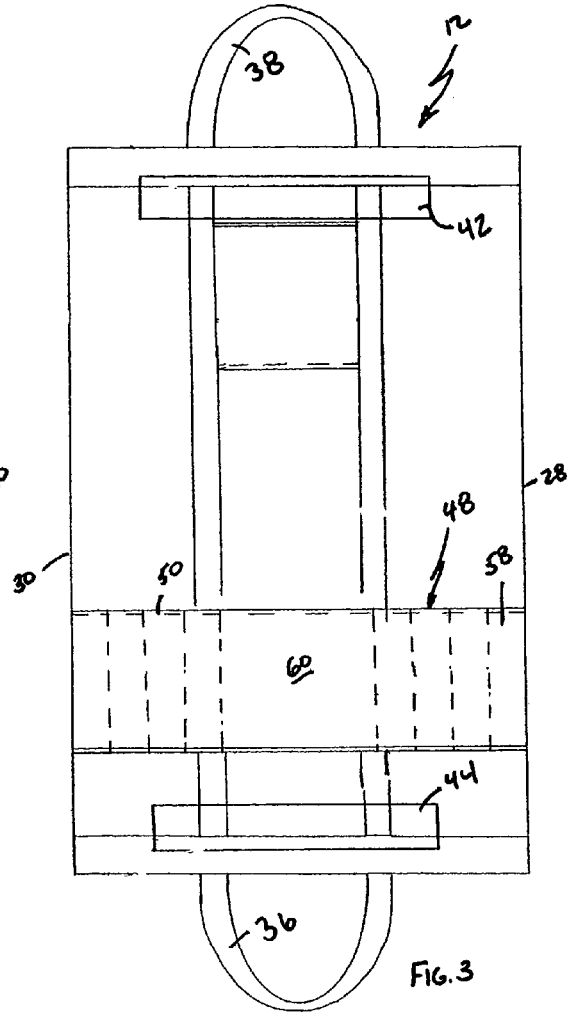
FIG. 3 shows the attachment of the inner pocket and zipper portions to the interior portions of the front and back of the tote as shown in FIGS. 1 and 2.

FIG. 3 shows the interior of the fabric 12 with the zipper portions 42,44 connected thereto as well as the inside pouch 48 and attached trim 50 connected to the back 18. Sewing is once again the preferred method of connection. The pouch 48 is subdivided into compartments, preferably including long narrow compartments 58 as well as wider compartment 60. The narrow compartments, especially when disposed along the sides 28, 30 are useful for storing needles. When long needles are stored, it should be noted that the zipper portions 42,44 do not extend to the sides 28, 30 thereby allowing at least some of the needles to extend past the zipper portions 42,44 when connected together.

Figure 4:
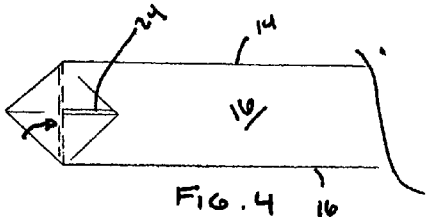
FIG. 4 shows the joining of the front to the back to provide sides as well as the connection to form the bottom of the tote.

With the interior and the exterior of the fabric 12 having the appropriate portions connected thereto, the sides 28 and 30 can be joined together, respectively to define the bottom 16. FIG. 4 shows the left side 28 as it would appear after folding together upon itself, using binding tape piece 24 to hide the seam and then folding down on top of bottom 16 inside the tote 10.

FIG. 5 shows the tote 10 in an assembled state. Since the fabric 12 is transparent, preferably clear, the interior pouch 48 with compartments 58,60 is visible through the front 14. The leash 54 is also visible, although the purse 52 would be flat against the bottom 16 and preferably camouflaged relative to the bottom insert 46 which would preferably include some rigidity to support the weight of items placed inside the tote 10. The purse 52 is shown removed from the tote 10 for illustrative purposes in FIG. 5.

Yarn Keeper

Figure 7:
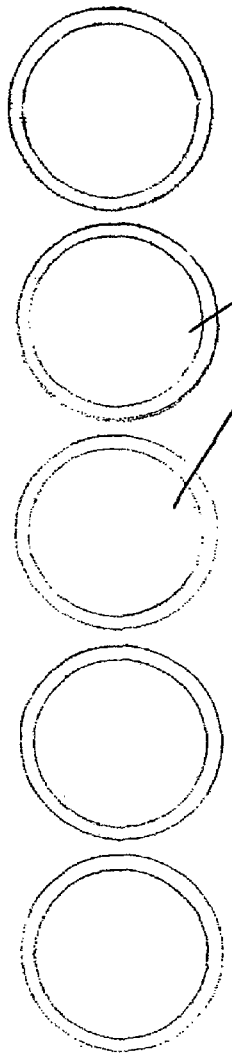
FIG. 7 shows the six discs connected together during a manufacturing step with sew lines shown in phantom.
Figure 7:
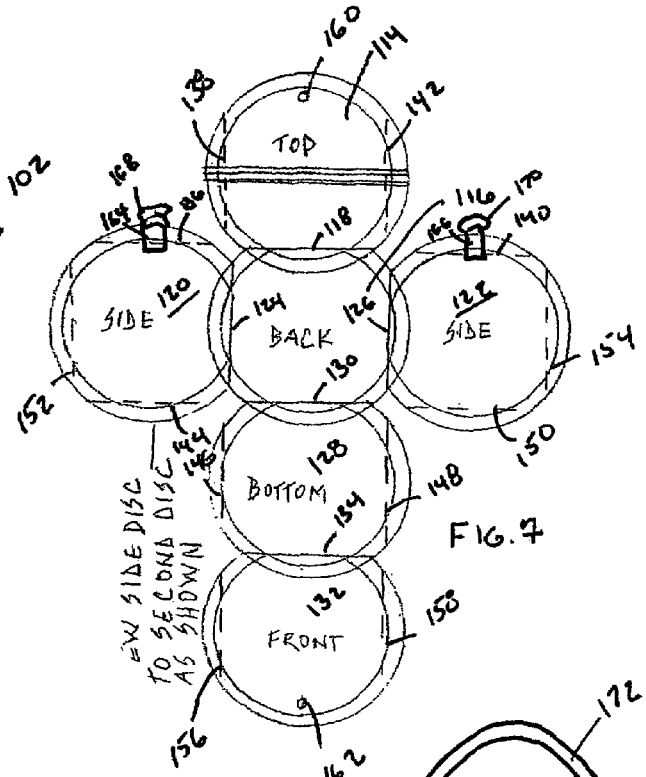
Figure 6:
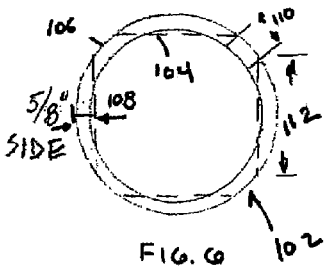
FIG. 6 shows six discs prior to being assembled into a yarn keeper in accordance with the presently preferred embodiment of the present invention.
Figure 8:
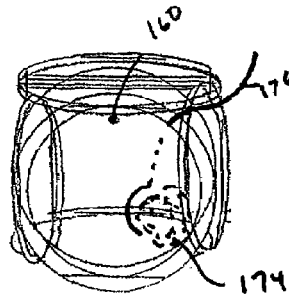
FIG. 8 shows an assembled yarn keeper in an in-use configuration.
Figure 9:
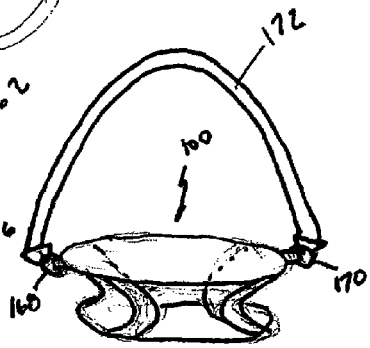
FIG. 9 shows an assembled yarn keeper in a storage configuration.

FIGS. 6-9 are useful to show the preferred embodiment of a yarn keeper 100 and its assembly as shown in an in use configuration in FIG. 8 and a storage configuration in FIG. 9. The keeper 100 is preferably formed of six discs 102, which for ease of assembly may be similarly constructed. As shown at the bottom of FIG. 6 in the bottom most disc 100, sew lines 104 are preferably spaced from the periphery 106 of the disc by a predetermined distance 108 so that a predetermined spacing 110 occurs between sew lines 104. The purpose will be discussed in further detail below. The sew lines extend a second predetermined distance 112 along four sides of the discs 102. The discs 102 are preferably formed of transparent, if not clear, vinyl or other appropriate material.

The discs 102 are connected as shown in FIG. 7 so that a top 114 connects to a back 116 along sew line 118. Back 118 also connects to sides 120 and 122 at sew lies 124 and 126 as well as to bottom 128 at sew line 130. The bottom 128 connects to the front 132 at sew line 134. Sides 120, 122 also connect to bottom with sew lines 144 connecting to 146 and 148 connecting to 150. Finally side sew lines 152 and 154 connect to front sew lines 156, 158 respectively.

The back sew line 118 acts as a hinge thereby hingedly connecting the top 114 to the back 116 allowing it to open and close to define a space within the keeper 100. Tabs 160,162 such as interlocking loops or other connectors can be utilized to place the keeper in a closed configuration as shown in FIGS. 8 and 9. Loops 164, 166 connect to D-rings 168 and 170 in the preferred embodiment for connecting to carrying strap 172.

With a yarn bundle, such as a ball 174 placed within the keeper 100 as shown in FIG. 8, a yarn end 176 may be snaked through one of the four gaps 178 created by the sew lines not connecting together toward the top (or the bottom) so that a user can "keep" a yarn bundle in the keeper 100 while in use.

When the keeper 100 is not in use, the sides 120, 122, back 116 and front 132 may be folded inwardly like a flower so that the top 114 remains parallel to the bottom 128, but closer to one another than as shown in FIG. 8. Accordingly the keeper 100 can be made to be relatively flat for storage. The keeper 100 may be stored in the interior pouch 48 of the tote 10 when in the storage configuration and provided as a kit, possibly together with needle wrap 200 in some embodiments.

Needle Wrap

Figure 10:
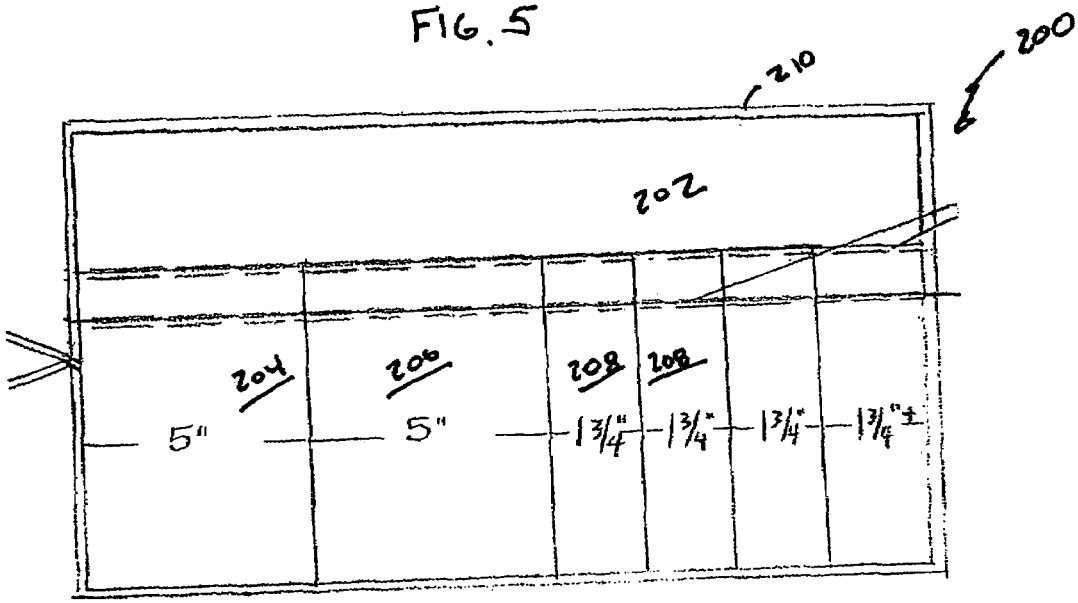
FIG. 10 shows an assembled needle wrap in accordance with a presently preferred embodiment.

FIG. 10 shows a needle wrap 200 which is preferably comprised of a fabric 202 folded upon itself to create compartments 204, 206, 208 of various dimensions for holding needles, accessories, etc. Binding tape 210 or other trim extends around edges of the fabric 202 to provide a professional and finished looking product. Finally ribbon 212 provides a tie string to wrap around a rolled wrap 200 when the wrap is rolled from side 214 to 216 with the ribbon then tied around the roll. A frosted vinyl or other appropriate material is utilized.

Biding tape, as described throughout this application, may take various forms as is known in the art such as one half inch bias tape sewn so that it is one quarter inch around an edge of fabric. Ribbon may be any fabric strip as is known in the art. Grosgrain ribbon is preferred for many embodiments.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention, what is claimed herein is:

1. A yarn keeper comprising:

a back disc connected to the first and second side discs at parallel disposed first sew lines;

a front disc connected to the first and second side discs at parallel disposed second sew lines;

a bottom disc connected to the first and second side discs at parallel disposed third sew lines; said parallel third sew lines perpendicular to the first and second sew lines;

a top disc hingedly connected relative to the back disc and selectively securable relative to the front disc;

a space defining an interior of the keeper in an in-use configuration;

at least one gap located intermediate the top disc and at least one of the first and second sew lines toward a top portion of at least one of the first and second side discs, said at least one gap communicating the interior of the keeper with an exterior of the keeper and providing an access for at least one yarn ball when located in the interior of the keeper in an in-use configuration to communicate at least one yarn strand through said at least one gap; and wherein the keeper has a storage configuration in which the side discs, front and back discs are folded inwardly while the top and bottom discs remain at least substantially parallel with the top and bottom discs closer to one another in the storage configuration than in the in-use configuration.

2. The yarn keeper of claim 1 wherein the front, back, bottom, first side and second side discs are substantially circular.

3. The yarn keeper of claim 2 wherein four gaps are located toward the top of the sides.

4. The yarn keeper of claim 3 further comprising at least one gap located intermediate the bottom disc and at least one of the first and second sew lines toward a bottom portion of at least one of the first and second side discs, said at least one gap communicating the interior of the keeper with an exterior of the keeper and providing an access for at least one yarn ball when located in the interior of the keeper in an in-use configuration to communicate at least one yarn strand through said at least one gap.

5. The yarn keeper of claim 1 in combination with a ball of yarn.

6. The yarn keeper of claim 1 wherein the front, back, bottom, top, first side and second side discs front, back, bottom, first side and second side discs are at least somewhat transparent.

7. The yarn keeper of claim 1 wherein when in the storage configuration, the first and second side discs fold inwardly at about the midpoint of the respective first and second side discs.

8. The yarn keeper of claim 6 wherein when in the storage configuration, the front and back discs fold inwardly at about the midpoints of the respective front and back discs.

9. The yarn keeper of claim 1 wherein the bottom disc is connected to the front and back discs along parallel disposed fourth sew lines, said fourth sew lines perpendicular to the first and second sew lines.

10. The yarn keeper of claim 9 further comprising four gaps disposed toward the top of the sides and four gaps disposed toward the bottom of the sides.

11. The yarn keeper of claim 10 in combination with a tote provided as a kit, said tote having: a front, bottom and a back, said front and back connected along sides; handles operably connected to the front and back; connector portions selectively connecting the front to the back above the bottom which terminate at least on one end prior to reaching one of the sides allowing for longer objects to extend there past while defining an interior pouch intermediate the front, back, sides, connector portions and bottom.

12. The yarn keeper and tote kit of claim 11 wherein the tote further comprises a leash connected to a purse, said purse being opaque and provided in a pattern which matches a pattern of the bottom.

13. The yarn keeper and tote kit of claim 11 wherein the keeper in the storage container fits within the interior pouch of the tote.

14. A yarn keeper comprising:

a back disc connected to first and second side discs at parallel disposed first sew lines;

a front disc connected to the first and second side discs at parallel disposed second sew lines;

a bottom disc connected to the first and second side discs at parallel disposed third sew lines; said parallel third sew lines perpendicular to the first and second sew lines;

a top disc hingedly connected relative to the back disc and selectively securable relative to the front disc;

a space defining an interior of the keeper in an in-use configuration;

at least one gap located intermediate the bottom disc and at least one of the first and second sew lines toward a bottom portion of at least one of the first and second side discs, said at least one gap communicating the interior of the keeper with an exterior of the keeper and providing an access for at least one yarn ball when located in the interior of the keeper in an in-use configuration to communicate at least one yarn strand through said at least one gap; and wherein the keeper has a storage configuration in which the side discs, front and back discs folded inwardly while the top and bottom discs remain at least substantially parallel with the top and bottom discs closer to one another in the storage configuration than in the in-use configuration.

15. The yarn keeper of claim 14 wherein the discs are at least substantially circular and four gaps are located toward the bottom of the sides spaced from each other on the respective first and second side discs by the third sew lines.

16. The yarn keeper of claim 14 further comprising at least one gap located intermediate the top disc and at least one of the first and second sew lines toward a top portion of at least one of the first and second side discs, said at least one gap communicating the interior of the keeper with an exterior of the keeper and providing an access for at least one yarn ball when located in the interior of the keeper in an in-use configuration to communicate at least one yarn strand through said at least one gap.

17. The yarn keeper of claim 16 further comprising four gaps at the tops of the first and second sides matching provided by the four gaps located toward the bottom of the first and second sides.

18. The yarn keeper of claim 14 wherein the at least some portions of at least one of the front, back, bottom, top, first side, and second side discs are at least somewhat transparent.

19. A tote comprising:

a front, bottom and a back, said front and back connected along sides and being at least substantially transparent;

handles operably connected to the front and back;

connector portions selectively connecting the front to the back above the bottom which terminate at least on one end prior to reaching one of the sides allowing for at least some long objects to extend there past while defining an interior intermediate the front, back, sides, connector portions and bottom; and a leash connected to a purse, said purse being opaque and provided in a pattern which matches a pattern of the bottom.

20. The tote of claim 19 in combination with a yarn keeper provided as a kit, said yarn keeper having a back disc connected to first and second side discs at parallel disposed first sew lines;

a front disc connected to the first and second side discs at parallel disposed second sew lines;

a bottom disc connected to the first and second side discs at parallel disposed third sew lines; said parallel third sew lines perpendicular to the first and second sew lines;

a top disc hingedly connected relative to the back disc and selectively securable relative to the front disc;

a space defining an interior of the keeper in an in-use configuration;

at least one gap located intermediate at least one of the top disc and at least one of the first and second sew lines toward a top portion of at least one of the first and second side discs and the bottom disc and at least one of the first and second sew lines toward a bottom portion of at least one of the first and second side discs, said at least one gap communicating the interior of the keeper with an exterior of the keeper and providing an access for at least one yarn ball when located in the interior of the keeper in an in-use configuration to communicate at least one yarn strand through said at least one gap; and wherein the keeper has a storage configuration in which the side discs, front and back discs are folded inwardly while the top and bottom discs remain at least substantially parallel with the top and bottom discs closer to one another in the storage configuration than in the in-use configuration.

* * * * *